US009200497B1

(12) United States Patent
Lugo et al.

(10) Patent No.: US 9,200,497 B1
(45) Date of Patent: Dec. 1, 2015

(54) SENSING AND MONITORING SYSTEM FOR USE WITH AN ACTUATOR OF A SUBSEA STRUCTURE

(75) Inventors: Mario R. Lugo, Houston, TX (US); Noel Mascarenhas, Houston, TX (US); Roger Feng, Houston, TX (US); Brett Morry, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 806 days.

(21) Appl. No.: 13/397,150

(22) Filed: Feb. 15, 2012

Related U.S. Application Data

(60) Provisional application No. 61/551,601, filed on Oct. 26, 2011.

(51) Int. Cl.

| | |
|---|---|
| ***E21B 43/01*** | (2006.01) |
| ***E21B 33/035*** | (2006.01) |
| ***E21B 33/038*** | (2006.01) |
| ***E21B 33/043*** | (2006.01) |
| ***E21B 17/06*** | (2006.01) |
| ***E21B 33/06*** | (2006.01) |

(52) U.S. Cl.
CPC ..... *E21B 33/06* (2013.01)

(58) Field of Classification Search
CPC ..... E21B 33/06; E21B 33/068; E21B 21/106; E21B 21/10
USPC ..... 166/344, 345, 351, 363, 368, 373, 85.4; 137/315.02; 251/1.1, 1.2, 1.3
See application file for complete search history.

(56) References Cited

U.S. PATENT DOCUMENTS

| | | | | | |
|---|---|---|---|---|---|
| 2,431,319 | A * | 11/1947 | Ellwood | F42B 22/04 | 102/212 |
| 4,122,498 | A * | 10/1978 | Dyer | G07C 1/10 | 346/20 |
| 4,337,653 | A * | 7/1982 | Chauffe | E21B 34/16 | 137/554 |
| 4,676,310 | A * | 6/1987 | Scherbatskoy | E21B 23/10 | 166/113 |
| 4,690,033 | A * | 9/1987 | Van Winkle | F15B 15/261 | 91/43 |
| 5,095,988 | A * | 3/1992 | Bode | E21B 21/10 | 137/268 |
| 5,320,325 | A * | 6/1994 | Young | E21B 33/062 | 251/1.3 |
| 5,331,152 | A * | 7/1994 | Fenton | G01D 5/268 | 250/227.11 |
| 7,231,837 | B2 * | 6/2007 | McCoy, Jr. | B25J 13/088 | 324/207.2 |
| 7,261,162 | B2 * | 8/2007 | Deans | E21B 41/0007 | 166/250.01 |
| 7,296,486 | B2 * | 11/2007 | Holtz | G01D 5/145 | 324/207.2 |

(Continued)

*Primary Examiner* — Matthew R Buck
*Assistant Examiner* — Edwin Toledo-Duran
(74) *Attorney, Agent, or Firm* — Egbert Law Offices, PLLC

(57) ABSTRACT

A sensing system for use with a subsea actuator has an actuator with a cylinder having a piston therein, and a piston rod extending outwardly of the cylinder, a magnetic member connected to or cooperative with an end of the piston rod, and a magnetic field sensor positioned over the magnetic member so as to sense magnetic field changes in relation to a movement of the magnetic member relative to the magnetic field sensor. A data acquisition system is cooperative with the magnetic field sensor for receiving a signal from the magnetic field sensor. A housing is positioned over the magnetic field sensor and over the magnetic member. The magnetic member moves through the housing in relation to a movement of the piston rod.

5 Claims, 2 Drawing Sheets

(56) References Cited

U.S. PATENT DOCUMENTS 7,300,033 B1 * 11/2007 Whitby ..... E21B 33/062 166/85.4
7,711,322 B2 * 5/2010 Rhodes ..... H04B 13/02 340/850
7,953,425 B2 * 5/2011 Jordan ..... G07C 5/008 455/431
2003/0052670 A1 * 3/2003 Miszewski ..... E21B 47/0905 324/228
2005/0283276 A1 * 12/2005 Prescott ..... E21B 47/06 700/282
2007/0289373 A1 * 12/2007 Sugiura ..... E21B 7/062 73/152.46
2008/0217022 A1 * 9/2008 Deans ..... E21B 47/12 166/338
2008/0289876 A1 * 11/2008 King ..... E21B 15/00 175/40
2009/0263225 A1 * 10/2009 Faccio ..... B66C 23/708 414/718
2009/0277644 A1 * 11/2009 McStay ..... E21B 33/035 166/336
2010/0135122 A1 6/2010 Rhodes et al.
2010/0159827 A1 6/2010 Rhodes et al.
2011/0174500 A1 * 7/2011 Davies ..... E21B 17/023 166/378
2011/0177779 A1 * 7/2011 Rhodes ..... H04B 11/00 455/40
2012/0000646 A1 * 1/2012 Liotta ..... E21B 33/062 166/85.4

* cited by examiner

SENSING AND MONITORING SYSTEM FOR USE WITH AN ACTUATOR OF A SUBSEA STRUCTURE

CROSS-REFERENCE TO RELATED APPLICATIONS

The present application claims priority from U.S. Provisional Patent Application Ser. No. 61/551,601, filed on Oct. 26, 2011, and entitled "Event Recorder for Subsea Structures".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to sensing and monitoring systems for use for use in association with subsea structures. More particularly, the present invention the relates to sensing systems that can be applied onto the actuator of the subsea structure. Additionally, the present invention relates to system whereby the position of an actuator can be monitored and data relating to the position of the actuator stored.

2. Description of Related Art Including Information Disclosed Under 37 CFR 1.97 and 37 CFR 1.98

As the need for hydrocarbon increases throughout the world, there is a constant demand for the increasing of offshore oil production. Typically, offshore oil production will include a variety of subsea structures that are utilized so as to control the flow of hydrocarbons from the well. Typically, blowout preventers are placed upon the wellhead. The blowout preventers will include a wide variety of mechanisms that are used so as to control the flow of fluids from the wellhead. These blowout preventers often include rams and valves which operate for the purpose of closing the wellhead in emergency or "blowout" conditions.

There are a variety of other subsea structures that are employed for the production of hydrocarbons. In addition to the blowout preventer stack, the other equipment can include subsea manifolds, Christmas trees, umbilical termination assemblies, subsea distribution units, manifolds, PLETS, PLEMS and capping stacks. Each of these subsea control systems has a variety of operational parameters that can be monitored by gauges, sensors, and other equipment.

Under certain circumstances, disasters can occur subsea. As in the case of the Macondo oil spill in the Gulf of Mexico, the blowout preventer became defective and, as a result, lacked the ability to control the flow of hydrocarbons. This resulted in a blowout. Although the blowout preventer was monitored at the surface, there was no definitive evidence, at the subsea location, of the events that transpired which led to the blowout. Under certain circumstances, the monitoring of the blowout preventer at the surface of the body of water is not always recorded. Additionally, it is possible for the operators to manipulate the recorded data at the surface of the body of water. As such, a need has developed so as to be able to record the data associated with a particular piece of subsea equipment which is tamper-proof, accurate, and verifiable.

In the event of a subsea explosion, most of the gauges, sensors, displays and monitors associated with the subsea piece of equipment become destroyed. This is especially the case in the subsea environment where many of the various small components that are left as a result of an explosion are virtually untraceable. As such, it becomes impossible to retrieve data from a very large event, such as an explosion, has occurred subsea.

One of the problems associated with the use of subsea monitoring equipment is the need for battery power. Batteries can eventually discharge and data can be lost, as a result. It becomes very difficult to maintain such batteries in their fully charged capacity. Since the subsea equipment can be used over the course of many years, the potential for battery discharge is great. As such, most companies have avoided the use of such subsea monitoring equipment.

The various subsea structures employed a wide variety of valves, actuators and control systems. Typically, the operation of such valves and actuators has been monitored by an inferred relationship to pressure. For example, an operator will know that a valve has been actuated when an increase or decrease in the monitored pressure occurs. However, this is a very indirect assessment of the proper operation of the control system of the subsea structure Changes in pressures can occur even when a particular valve is working improperly or incompletely. Often, the actuator associated with the valve does not move in its entire intended range. The partial opening or closing of a valve can lead to major problems in the production of hydrocarbons or can eventually lead to emergency or blowout conditions. As such, a need exists to be able to properly monitor the specific movement of the actuator and/or valve in a direct realtime manner.

Under other circumstances, the operation of actuators and/or valves is visually observed from the remotely-operated vehicle (ROV). The camera equipment associated with the ROV is positioned so as to observe a telltale associated with the actuator. As such, a visual observation of actuator movement can occur. This is quite difficult to manage since an ROV will need to be positioned for such observation. Additionally, the murky conditions of the subsea environment will create difficulties in the ability to properly observe the true movement of the telltale. The visual observation of the operation of the actuator is not very precise. As such, the visual observation may lead one to believe that the actuator is properly working even when the valve is not completely opening or closing.

After an emergency or blowout situation, it is desirable to be able to record the proper functioning of the various actuators. As such, the monitoring of the exact position of the actuator can produce data that is particularly relevant in ascertaining fault or responsibility associated with such emergency or blowout conditions. This is particularly important since the inferred observation of the operation of such valves and/or actuators could lead to one that conclusion that all the valves are operating properly.

It is important in the operation of the subsea structures that repairs and maintenance be carried out whenever it should occur as quickly as reasonably possible so as to avoid the possibility of emergency conditions affecting the entire subsea system.

In the past, various patents have issued relating to communicating with and monitoring of subsea systems. For example, U.S. Pat. No. 4,122,498, issued on Oct. 24, 1978 to R. E. Dyer, describes a data recording apparatus including a data recording circuit for recording event data provided by a data source on a first track of a magnetic tape and a time recording circuit which effects the recording of time reference data for the event data on a second track of the tape. The time recording circuit includes a digital clock which provides encoded data representing month, day, hours and minutes for recording on the tape. There is also an identification data source which provides encoded data representing an identification number for the data source for recording on the tape. The time and identification data are recorded on the tape in a bi-phase format.

U.S. Pat. No. 7,261,162, issued on Aug. 28, 2007 to Deans et al., shows a subsea communications module which includes an interface to communicate with a surface facility over a communications link using a packet-based protocol. The communications link can be implemented with a fiberoptic line, a wire-based line, and/or other types of communications lines.

U.S. Pat. No. 7,711,322, issued on May 4, 2010 to Rhodes et al., provides an underwater communications system and method. The underwater communications system is provided so as transmit electromagnetic and/or magnetic signals to a remote receiver. The transmitter includes a data input. A digital data compressor compresses data to be transmitted. A modulator modulates compressed data onto a carrier signal. An electrically-insulated, magnetically-coupled antenna transmits the compressed, modulated signals. The receiver that has an electrically-insulated, magnetic-coupled antenna for receiving a compressed, modulated signal. A demodulator is provided for demodulating the signal to reveal compressed data. A de-compressor decompresses the data. An appropriate human interface is provided to present transmitted data into text/audio/visible form.

U.S. Pat. No. 7,953,425, issued on May 31, 2011 to L. B. Jordan, teaches a universal event/data recorder system. This recorder system provides a common bridge between various event/data recorders found on mobile assets. The universal event/data recorder system includes an onboard segment that is capable of interfacing with any manufacturer's event/data recorder device. Additionally, the universal event/data recorder system also includes a remote segment for accessing, analyzing and reviewing data collected from any of a plurality of event/data recorders. The universal event/data recorder system may allow accessing data from various event/data recorders using any of a number of communication means including the Internet and a wireless communication network.

U.S. Patent Publication No. 2005/0283276, published on Dec. 22, 2005 to Prescott et al., describes a real-time subsea monitoring and control system for pipelines. This method includes installing a monitoring system for measuring at least one parameter of interest. The monitoring system includes various monitoring sensors placed at selected locations along the pipeline. A series of measurements are taken using the monitoring sensors in real-time. The measurements are analyzed to identify anomalous conditions existing in the pipeline being monitored. An autoadaptive corrective action is implemented based upon the real-time measurement of the parameter of interest.

U.S. Patent Publication No. 2008/0217022 shows a subsea communication multiplexer. This is a system for communicating between a surface facility and a subsea production control system. The water surface communications device has at least one communication interface. A communications device is functionally associated with a wellhead or subsea structure proximate the water bottom. The water bottom communications device has at least one communication interface. A communication channel extends between the surface communication device and the water bottom communication device. A multiplexer is functionally coupled to the communication interface on each of the surface and water bottom communication devices. At least two remote devices are functionally coupled to the water bottom multiplexer. The remote devices include at least one of a sensor and a control. At least two corresponding devices are coupled to the surface multiplexer. The corresponding devices include at least one of a signal acquisition device and a control signal generating device.

U.S. Patent Publication No. 2008/0289876, published on Nov. 27, 2008 to King et al., teaches a method and system for monitoring auxiliary operations on mobile drilling units. This system includes at least one sensor configured to measure a parameter related to a start time and a stop time of at least one auxiliary operation on the drilling unit. The system includes a data acquisition device configured to determine a start time and a stop time of the auxiliary operation from measurements made by the sensor. The data acquisition device includes a data recorder for recording elapsed time between the start time and the stop time.

U.S. Patent Publication Nos. 2010/0135122, 2010/0159827 and 2011/0177779, published to Rhodes et al., describe underwater communication systems that are provided to transmit electromagnetic and/or magnetic signals to a remote receiver. The transmitter includes a data input. A digital data compressor compresses data to be transmitted. A modulator modulates compressed data onto a carrier signal. An electrically-insulated, magnetically-coupled antenna transmits the compressed modulated signals. The receiver has an electrically-insulated, magnetically-coupled antenna for receiving a compressed, modulated signal. A demodulator is provided for demodulating the signal to reveal compressed data. A de-compressor decompresses the data. An appropriate human interface is provided to present transmitted data into text/audio/visible form.

Various patents and publications have also issued relating to position sensors. For example, U.S. Pat. No. 5,331,152, issued on Jul. 19, 1994 to S. P. Fenton, shows a sensor for a valve member or choke for oil and gas production. This sensor detects the position of an object that moves along a linear path. The sensor includes a holder with input and output fiberoptic tubes extending into the holder. The ends of the fiberoptic tubes are located adjacent to the moving object. The moving object has a reflecting portion which will reflect light back when located in registry with the fiberoptic tubes.

U.S. Pat. No. 7,231,837, issued on Jun. 19, 2007 to R. W. McCoy, Jr., describes an angular movement detector and networks of angular movement detectors for controlling movement of an articulated arm. The angular movement detectors are disposed within or proximate to joints in one or more members of articulated arms and linked via one or more communications networks to a controller so as to provide angular movement data to the controller for use in controlling movement of the articulated arm. At least one sensor is disposed in the angular movement detector and adapted to detect an orientation of a magnetic field and produce a digital signal representation of the sensed magnetic field. A magnetic field generator is disposed external to the angular movement detector.

U.S. Pat. No. 7,296,486, issued on Nov. 20, 2007 to Holtz et al., provides an angular movement detector that is disposed within or proximate to joints in one or more members of articulated arms. These detectors are linked by way of one or more communications networks to a controller to provide angular movement data to the controller for use in controlling movement of the articulated arm. The angular movement detector comprises a hydraulic motor drive sensor adapter which uses an eccentrically rotating main shaft to rotate a drive shaft to which the main shaft is loosely connected to further rotate a socket housing about a constant central axis. The sensor is able to detect an orientation of an electromagnetic field and can comprise one or more anisotropic magneto-resistive sensors, Hall-effect sensors, or the like. A trigger is provided that can include a magnet, or other source of a magnetic field, where the generated magnetic field is strong enough to be detected by the sensor.

U.S. Patent Publication No. 2003/0052670, published on Mar. 20, 2003 to A. Miszewski, provides non-invasive detector for a well. This detector detects magnetic field disturbances resulting from the movement of equipment through a pipe of magnetic material. A pair of linear ferrite magnetic elements are positioned in end-to-end relationship and aligned with the axis of the pipe. A Hall effect drive is positioned between the magnetic elements. The ferrite rods concentrate magnetic field changes due to the equipment through the Hall effect device. Two pairs of elements are spaced around the pipe and a second set of pairs of elements are spaced along the pipe. The detector is attached to an existing pipe or mounted in an instrument package which passes through the pipe.

U.S. Patent Publication No. 2007/0289373, published on Dec. 20, 2007 to J. Sugiura, describes a rotary steerable steering tool having a sensor arrangement for measuring downhole dynamic conditions. The rotary steerable tools include a rotation rate measurement device disposed to measure a difference in rotation rate between a drive shaft and an outer, substantially non-rotating housing. A controller is configured to determine a stick/slip parameter from the rotation rate measurements.

It is an object of the present invention to provide a sensing and monitoring system that is able to directly measure the movement of a valve and/or actuator within the subsea system.

It is another object of the present invention to provide a sensing and monitoring system which allows the position of an actuator and/or valve to be monitored in realtime.

It is still another object of the present invention to provide a sensing and monitoring system in which the data associated with the particular actuator and/or valve can be stored in a "black box"-type structure.

It is another object of the present invention to provide a sensing and monitoring system that can be effectively utilized in the deep subsea environment.

It is another object of the present invention to provide a sensing and monitoring system in which the system can be retrofitted to existing actuators.

These and other objects and advantages of the present invention will become apparent from a reading of the attached specification and appended claims.

BRIEF SUMMARY OF THE INVENTION

The present invention is a sensing system for use with a subsea actuator. The sensing system comprises an actuator with a cylinder having a piston therein. The piston has a piston rod connected thereto and having a first end extending outwardly of the cylinder and an opposite end extending outwardly of an opposite end of the cylinder. A magnetic member is connected to or cooperative with the opposite end of the piston rod. A magnetic field sensor is positioned over the magnetic member so as to sense magnetic field changes in relation to a movement of the magnetic member relative to the magnetic field sensor. A data acquisition system is cooperative with the magnetic field sensor for receiving a signal from the magnetic field sensor. The magnetic member has graduations formed on an exterior surface thereof. A housing is positioned over the magnetic field sensor and over the magnetic member. The housing is formed of a magnetic material. The magnetic member moves through the housing in relation to a movement of the piston rod.

In one embodiment of the present invention, the magnetic member is fastened to the opposite end of the piston rod so as to be axially aligned with the piston rod.

In another embodiment of the present invention, there is provided a wedgelock movable in relation to a piston. The wedgelock is positioned relative t the opposite end of the piston rod. The wedgelock has a position away from the opposite end of the piston rod when the piston rod is in a first position. The wedgelock abuts the opposite end of the piston rod when the piston rod is in a second position. The magnetic member is affixed to the wedgelock. The wedgelock includes a wedge, a rod having one end affixed to the wedge and extending from the wedge, a piston affixed to the rod, and a cylinder extending over the piston. The rod has an magnetic member affixed to an opposite end of the rod.

In another embodiment of the present invention, a clamp affixed over an exterior surface of the piston rod. The magnetic member positioned over an exterior of the clamp. A housing is clamped over the clamp and the magnetic member. The magnetic field sensor is positioned within the housing so as to reside over the magnetic member. A receptacle can be affixed to the opposite end of the piston rod. The receptacle is suitable for manipulation by an remotely-operated vehicle. The clamp is positioned between the receptacle and the actuator.

In still another embodiment of the present invention, a telltale member is affixed to the piston rod and extends outwardly therefrom. The magnetic member is affixed to the telltale member. This telltale member includes a collar that is affixed over an exterior surface of the piston rod. An arm extends radially outwardly of the collar. The arm has a transverse portion extending away from the actuator. The magnetic member is affixed to this transverse portion.

The present invention is also a monitoring system for use with an actuator of a subsea structure. The monitoring system comprises a container, a data acquisition system positioned in the container, a power supply positioned in the container and cooperative with the data acquisition system so as to supply power to the data acquisition system, and a Hall effect sensor connected by a line to the data acquisition system. The Hall effect sensor is cooperative with the actuator so as to transmit data relative to a position of the actuator to the data acquisition system.

The Hall effect sensor comprises a magnetic member suitable for affixing to or interconnecting in relation to the actuator, and a magnetic field sensor positioned over the magnetic member so as to sense magnetic field changes in relation to a movement of the magnetic member relative to the magnetic field sensor. The magnetic member has graduations formed thereon. A housing is positioned over the magnetic field sensor and over the magnetic member. The housing is formed of a magnetic material. The magnetic member is movable through the housing in relation to a movement of the actuator.

A communicating means is connected to the data acquisition system. The communicating means serves to pass information to a location remote from the container. In particular, communicating means includes an inductive transmitter connected to the data acquisition system. The inductive transmitter is positioned exterior of the container so as to transmit data relative to the data from the Hall effect sensor. The monitoring system can further include a remotely-operated vehicle having an inductive receiver thereon. The inductive receiver is cooperative with the inductive transmitter so as to receive the transmitted data thereby.

The foregoing Summary of the Invention is intended to describe generally the preferred embodiments of the present invention. It is understood that various changes from the details of these preferred embodiments can be made within the scope of the present invention. This section should not be construed, in any way, as limiting of the scope of the present invention. The present invention should only limited by the following claims and their legal equivalents.

DETAILED DESCRIPTION OF THE INVENTION

Figure 1:
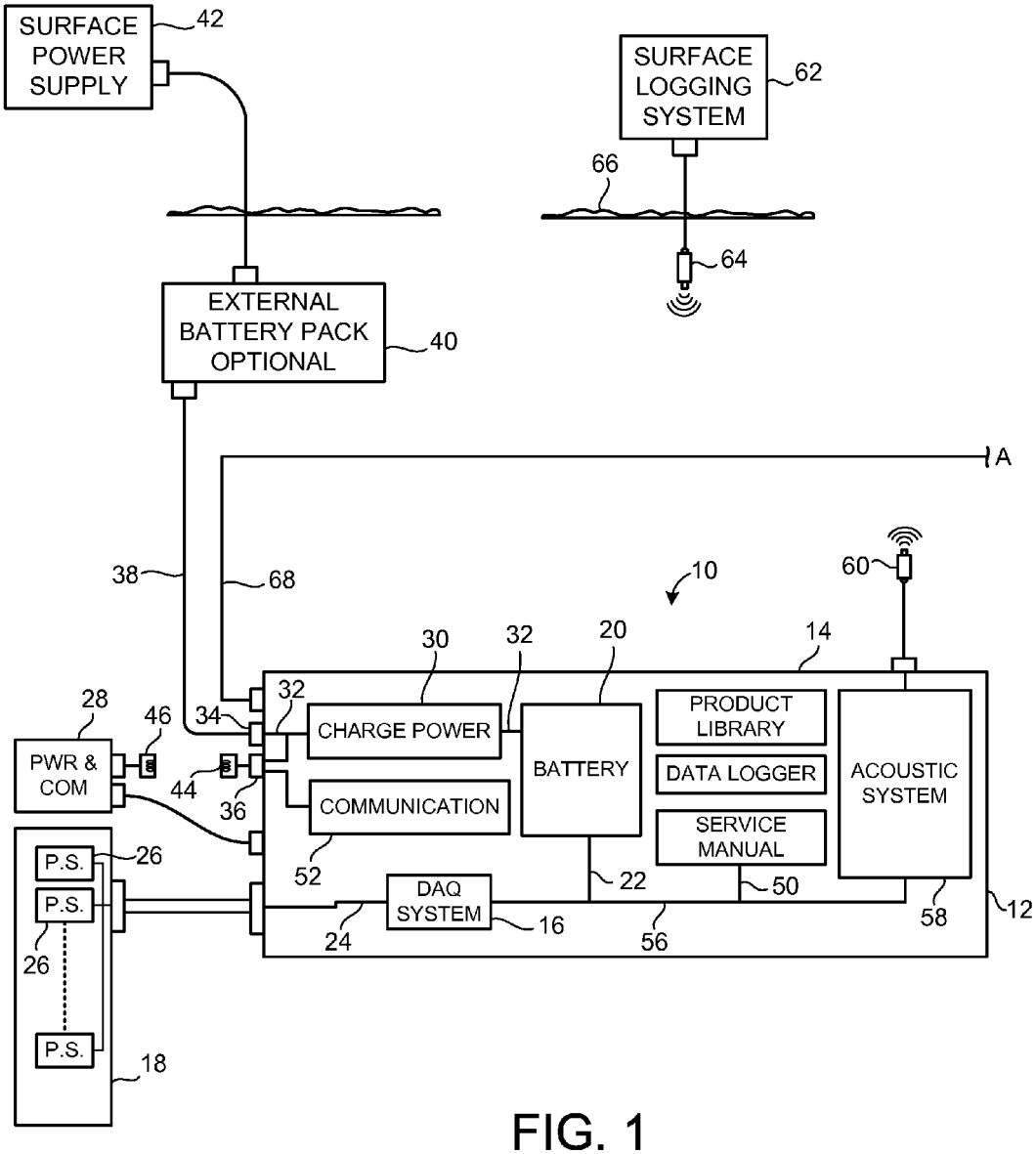
FIG. 1 is a diagrammatic illustration of the event recording system of the present invention.

FIG. 1 is a diagrammatic illustration of the event recording system 10 of the present invention. The event recording system 10 includes a container 12 having rigid walls 14. A data recorder 16 is positioned within the container 12. The data recorder 16 is suitable for receiving inputted data from the subsea structure 18. A power supply 20 is positioned in the container 12. The power supply 20 is connected by line 22 to the data recorder 16 so as to supply power to the data recorder 16. An input line 24 extends from the data recorder 16 outwardly of the container 12. In FIG. 1, it can be seen that the input line 24 extends to the subsea structure 18.

The subsea structure 18 is in the nature of a blowout preventer stack. The container 12 can be affixed to a surface of the blowout preventer stack 18. The input line 24 is connected by suitable lines or transmitters to the various controls and equipment associated with the subsea structure 18. As such, the data recorder 16 is suitable for monitoring conditions such as pressure, valve position, ram position, chronology of events, and the time of events. The data recorder 16 can also record the history of the subsea structure 18. For example, data can be entered into the data recorder 16 pertaining to the various repairs that were made to the subsea structure 18.

In the event of an explosion or subsea event, the container 12 and the data recorder 16 are always maintained in a package having great structural integrity. As such, it can recovered in the nature of an aircraft black box. If the explosion is enormous, the container 12 may be displaced from the subsea structure 18. As such, it is only necessary for an remotely-operated vehicle (ROV), such as ROV 28 to search for the data recorder 16 in an area proximity to the explosion. Suitable signaling devices can also be used in association with the data recorder 16 so that the recovery of the data recorder 16 by the ROV is facilitated.

The data recorder 16 is positioned within the container 12. The container 12 has explosion-proof rigid walls. Typically, the container 12 will be able to withstand pressures of up to 15,000 p.s.i. The container 12 can operate at up to 10,000 feet below sea level. Suitable fasteners can be provided whereby the container 12 can be rigidly secured to the surface of the subsea structure 18.

The data recorder 16 is positioned within the container 12. The data recorder 16 is connected so as to receive inputted data. The history of the subsea structure 18 is imparted to the data recorder. The history of the data recorder 16 can include drawings, specifications, manufacturer's information, repair history, and operating manuals. Once the subsea structure 18 is lowered into a body of water and place adjacent to the wellhead, the data recorder 16 is away from human intervention. As such, the data recorder 16 is completely tamper-proof. There is no way for a person to change the data that is recorded by the data recorder 16. If it is necessary to monitor the operation of the data recorder 16 or to retrieve information from the data recorder 16, then the ROV 28 can simply fly-by the data recorder 16 so as to receive information that is resident therein. A suitable password encoding can avoid any release of such information to unauthorized personnel.

In FIG. 1, it can be seen that the input line 24 is connected to pressure transducers 26 within the subsea structure 18. The subsea structure 18 can include item such as blowout preventer stack 18, Christmas trees, umbilical termination assemblies, distribution units, manifolds, PLETS, PLEMS and capping stacks.

The data recorder 16 is powered by the battery 12. A charger 30 is connected by line 32 to the battery 20. As such, the charger 30 can be utilized so as to recharge the battery. The charger 30 has a line 32 that extends to a pair of connectors 34 and 36 that are positioned on the wall of the container 12. Connector 34 is illustrated as affixed to a line 38 that extends to an external battery pack 40 and/or to a surface power source 42. In normal use, the ROV 28 can be utilized so as to stab the end of the line 38 into the connector 34 so as to allow the surface power supply 42 and/or the battery pack 40 into the connector 34. As such, the charger 30 is able to restore the power of the battery 20. Alternatively, the charger 30 can be charged by inductive charging. An inductive transmitter/receiver 44 is illustrated as extending outwardly of the connector 36. The ROV has an inductive receiver/transmitter 46 thereon. As such, the ROV 20 can pass in close proximity to the inductive transmitter/receiver 44 such that the inductive receiver/transmitter 46 can provide energy for the charging of the battery 20 by way of the charger 30. Alternatively, the ROV 28 can be utilized so as to manipulate the battery pack 40 so as to engage with the connector 34 so as to supply additional power to the charger and to the battery 20.

In FIG. 1, it can be seen that the data recorder 16 is connected by line 50 to a product library, a data logger and a service manual. As such, these separate components can act to store the requisite information that is secured from the subsea structure 18 by the data recorder 16.

The data recording system 10 of the present invention can provide communication to a surface location. A communicating system 52 is connected by line 54 to the data recorder 16. The communicating system 52 has a line extending to the inductive transmitter/receiver 44. As such, the ROV 28, through the use of its inductive receiver/transmitter 46 can fly by the inductive transmitter/receiver 44 so as to interrogate the data recorder 16. Once this interrogation is completed, the ROV 28 can move to a surface location so that such information can be properly downloaded. It should be noted that the inductive receipt of such data from the data recorder 16 is extremely fast. As a result, a great deal of information can be secured in a relatively small amount of time by virtue of this inductive transmitter/receiver 44 and the communicating system 52.

The data recorder 16 can also be connected by a line 56 to an acoustic system 58. The acoustic system 58 is connected to the antenna 60. Antenna 60 extends outwardly of the container 12. The acoustic system 58 is suitable for transmitting acoustic signals from the container 12 and outwardly thereof. A surface logging system 62 has a receiver 64 extending into the water 66. The receiver 64 is capable of receiving the acoustic signal as transmitted by the transmitter 60. As a result, the data from the data recorder 16 can be received by the surface logging system 62. It should be noted that the acoustic transmission of such information is relatively slow. As such, such information can be secured in a simple and convenient manner at the surface without the use of the ROV. However, such information will be secured over an extended period of time because of the relatively slow speed of such acoustic signal transmitting.

With reference to FIG. 1, the event recording system 10 is an integral package that can be applied to the subsea structure 18. All of the recording components are effectively contained within the interior of the container 12. The use of such black boxes in the past have been considered to be difficult or impossible since the battery would eventually discharge. As a result, the data would no longer be recorded once the battery has sufficiently discharged. The present invention allows the battery 20 to be continually charged in a safe and convenient manner. The battery 20 can either be recharged through the use of the ROV 28 or through the application of a battery pack to the exterior of the container 12.

In the event of a major subsea explosion, ROV 28 can be deployed in order to search for and secure the container 12 and its enclosed data recorder 16. The ROV 28 can then transport the container 12 to the surface of the body of water 66. The data within the data recorder 16 can then be analyzed so as to provide an accurate and complete record of the event or events that transpired which led to the explosion. This is a more foolproof way of identifying defective equipment, the manufacturers associated with the defective equipment, and the causes of the subsea event.

In the past, the measurement of the cycles of various valves and actuators associated with the subsea structure 18 is conducted by measuring pressures by way of pressure transducers 26. In other words, a change of pressure is indicative of an opening or closing of a particular valve. Unfortunately, in the past, this measure of pressure is only correlative and inferential of the opening and closing of the valves and actuators. As such, it is desirable that an accurate measurement of the movement of such actuators be carried out so that a direct measurement can be obtained by the data recorder 16 rather than an inferred measurement. As such, the data recorder 16 can be connected by line 68 to a Hall effect sensor in the manner illustrated in FIG. 2.

Figure 2:
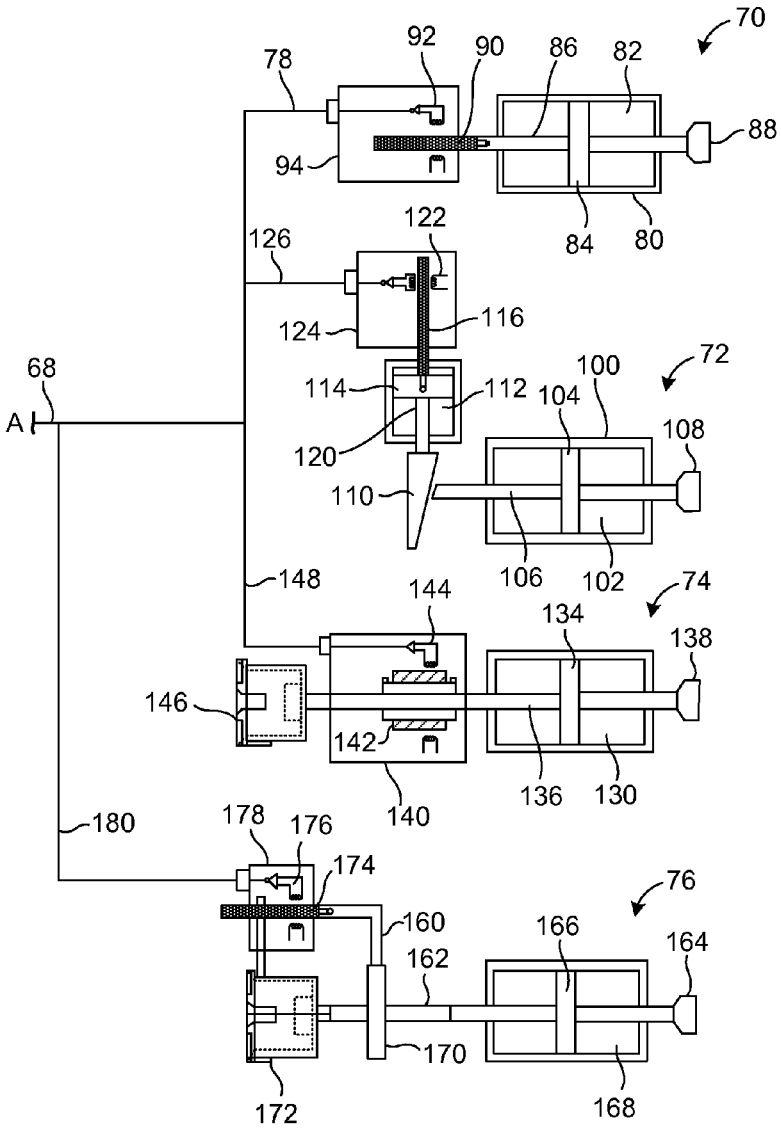
FIG. 2 is a diagrammatic and cross-sectional view of the Hall effect sensors as used in the event recoding system of the present invention.

In FIG. 2, line 68 can be connected to separate Hall effect sensors 70, 72, 74 and 76. The Hall effect sensor 70 is interconnected by line 78 to line 68 and to the data recorder 16. The Hall effect sensor 70 is associated with an actuator 80 associated with a valve, a blowout preventer, a connector choke, and other apparatus. The actuator 80 includes a cylinder 82 having a piston 84 positioned therein. Suitable hydraulic pressure is applied within the cylinder 82 so as to move the piston 84 and its associated piston rod 86 for the manipulation of the valve 88.

As can be seen, there is a graduated magnetic member 90 that is affixed to the end of the piston rod 86. Alternatively, the magnetic member could include magnetic elements positioned and spaced thereon. The magnetic member 90 can have threads or carvings formed on the exterior surface thereof. These threads or carvings will have a pitch. These threads and/or carvings can be sensed so that the position of the magnetic member so can be determined. A magnetic field sensor 92 is positioned within a magnetic housing 94 so as to establish a magnetic field with respect to magnetic member 90. The Hall effect sensor is a transducer that varies its output voltage in response to a magnetic field. Hall effect sensors have been used in the past for proximity switching, positioning, speed detection and current sensing applications. Electricity is carried through the conductor 78 so as to produce a magnetic field that varies with current. The Hall effect sensor can be utilized so as to measure the current without interrupting the circuit. Typically, the sensor is integrated with a wound core or permanent magnet that surrounds the conductor or magnetic member 90. As a result, the magnetic field will vary in relation to the movement of the magnetic member 90 in relation to the magnetic field sensor 92. This causes a very accurate determination of the movement of the piston 84 within the cylinder 82. As such, an accurate analysis of the opening and closing of the valve 88 can be achieved.

In certain circumstances, the valve 88 may move one direction or another in an less-than-optimum manner. As such, the sensor 70 is able to sense that this movement is not proper. The inferred method of determining the opening and closing of the valve 88 would still show pressure increases or pressure decreases. However, the sensor 70 of the present invention is able to show that this valve 88 is not operating properly. As a result, the present invention is able to record the data associated with the improperly operating valve 88. The interrogation of the data recorder 16 can lead users to the conclusion that the valve 88 requires replacement or maintenance The Hall effect sensor system 72 is illustrated as utilized with a blowout preventer ram actuator 100. The blowout preventer ram actuator 100 also includes a cylinder 102 and a piston 104. A piston rod 106 is connected to the piston 104 and connected to the ram 108. In normal use, when it is necessary to close the rams of a blowout preventer, the piston rod 106 will move in one direction. A wedgelock 110 will then drop so as to prevent the ram 108 from returning back to the original position. Typically, when the rams of a blowout preventer are closed, then the diaphragm of the flow passageway of the blowout preventer will be closed. In other operations, the ram 108 will serve to shear the drill pipe. Still in other circumstances, the ram 108 will operate so as to effectively squeeze the exterior surfaces of the drill pipe so as to effectively close the pipe. The wedgelock 110 serves to prevent the return of the ram 108 away from its closed position.

The wedgelock 110 is also connected to a cylinder 112 with a piston 114 located therein. The magnetic member 116 is affixed to the piston rod 120 that is connected to the wedgelock 110. The magnetic field sensor 122 is contained within a magnetic housing 124 so as to extend around the magnetic member 116. As such, the magnetic field sensor 122 utilizes the Hall effect so as to accurately show the lowering of the wedgelock 110 and the closing of the ram 108. The magnetic field sensor 122 can then transmit data along line 126 back to the data recorder 16 so that the actuate functioning of the ram 108 can be recorded and/or monitored. In other words, if the wedgelock 110 does not lower completely, then it would be indicative of the fact that the ram 108 had not moved to its full extent. As such, this would be indicative of a failure of the ram of the blowout preventer stack.

Hall effect sensor system 74 is illustrated as utilized with a pre-existing tree, a manifold, a pigging loop or other actuator. The Hall effect sensor 74 is field-installable. In particular, the Hall effect sensor 74 also has a cylinder 130 having a piston 134 therein. The piston rod 136 extends from the piston 134 and extends to the valve 138. Since it would normally be difficult to install a magnetic member onto the preexisting piston rod 134 located at the floor of the ocean, the present invention utilizes a suitable clampable housing 140 that will extend over the piston rod 134. In particular, there is the housing 140 will be in the nature of a clamshell which can be closed over the piston rod 134. As a result, the magnetic member 142 will be affixed in a compressive relationship over the exterior of the piston rod 136. The magnetic field sensor 144 is closed over the magnetic member 142 so as to sense the magnetic field produced from the magnetic member 142. The piston rod 134 has an ROV override connector 146 at an end thereof. The ROV override connector 136 can be manipulated by the ROV so as to open and close the valve 138 through a physical motion caused by the ROV. The magnetic field sensor 144 will transmit a signal along line 148 back to the data recorder 16 so as to show either the movement of the piston rod 134 in the opening and closing of the valve 138 or the accurate movement of the piston rod 136 as caused by the ROV override connector 136 and its operation by the ROV. This can provide a realtime analysis of how far the ROV must manipulate the connector 146 so as to achieve a full opening or closing of the valve 134. The housing 140 can be easily installed by the ROV over the existing piston rod 136 that extends outwardly of the cylinder 130.

The Hall effect sensor 76 is illustrated as utilized with an existing telltale 160. The telltale 160 is a mechanism that is commonly applied to existing piston rods 162 so that the camera equipment associated with an ROV can visually identify the movement of the piston rod 162 and the valve 164. Often, this visual indication from the ROV is not very accurate. As such, the use of such telltales has not been effective in the past.

The Hall effect sensor system 76 has the piston 166 positioned over the piston rod 162 within the cylinder 168. The piston rod 162 extends outwardly of the cylinder 168. A collar 170 is affixed over the piston rod 162 such that the telltale 160 extends radially outwardly therefrom. An ROV override connector 172 is provided at the end of the piston rod 162 so that the ROV can properly manipulate the inward and outward movement of the piston rod 162 and the movement of the valve 164.

In the Hall effect sensor 76, the magnetic member 174 is directly affixed to the telltale 160. The magnetic field sensor 176 extends over this magnetic member within the housing 178. Line 180 is connected the magnetic field sensor 176 and extends outwardly of the housing 178 such that data associated with the movement of the magnetic member 174 and its corresponding movement of the piston rod 162 and valve 164 can be recorded and/or directly monitored. As a result, realtime data can be provided as the ROV manipulates the piston rod 162 and the valve 164 so as to determine the accurate positioning of the valve 164. Additionally, if the valve system is not working properly, then such information can be recorded by the data recorder 16 for analyzing whether the valve 164 needs to be replaced or maintained. The present invention provides significantly better data to the operator of the well than the attempt to visually monitor the operation of the valve 164 by the telltale 160.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A sensing system for use with a subsea actuator, the system comprising:

an actuator having a first cylinder with a first piston therein, said piston having a piston rod affixed thereto, said piston rod having a first end extending outwardly of one end of the first cylinder and a second end extending outwardly of an opposite end of the first cylinder;

a magnetic member connected to or cooperative with said second end of said piston rod;

a magnetic field sensor positioned over said magnetic member so as to sense magnetic field changes in relation to a movement of said magnetic member relative to said magnetic field sensor; and a wedgelock movable in relation to the first piston of said piston rod, said wedgelock having a first position away from said second end when said piston rod is in a first position, said wedgelock abutting said second end of said piston rod when said piston rod is in a second position, said magnetic member being affixed to said wedgelock, said wedgelock comprising:

a wedge;

a rod having one end affixed to said wedge, said rod extending from said wedge;

a second piston affixed to said rod of said wedgelock; and a second cylinder extending over said second piston, said rod of said wedgelock having an opposite end, said magnetic member affixed to said opposite end of said rod of said wedgelock.

2. The sensing system of claim 1, further comprising:

a data acquiring means cooperative with said magnetic field sensor for receiving a signal from said magnetic field sensor as to the changes in the sensed magnetic field.

3. The sensing system of claim 1, further comprising:

a valve affixed to said first end of said piston rod.

4. The sensing system of claim 1, said magnetic member having graduations formed thereon.

5. A sensing system for use with a subsea actuator, the system comprising:

an actuator having a cylinder with a piston therein, said piston having a piston rod affixed thereto, said piston rod having a first end extending outwardly of one end of the cylinder and a second end extending outwardly of an opposite end of the cylinder;

a magnetic member connected to or cooperative with said second end of said piston rod;

a magnetic field sensor positioned over said magnetic member so as to sense magnetic field changes in relation to a movement of said magnetic member relative to said magnetic field sensor; and a telltale member affixed to said piston rod and extending outwardly therefrom, said magnetic member affixed to said telltale member, said telltale member positioned exterior of said cylinder, said telltale member comprising:

a collar affixed over an exterior surface of said piston rod; and an arm extending radially outwardly of said collar, said arm having a transverse portion extending away from said actuator, said magnetic member affixed to said transverse portion.

* * * * *